252-146 AU 166 EX
7/12/83 XR 4,392,977

United States Patent [19]
Altenschöpfer et al.

[11] 4,392,977
[45] Jul. 12, 1983

[54] LIQUID CLEANING AND MAINTENANCE COMPOSITION ESPECIALLY FOR DISHWASHERS

[75] Inventors: Theodor Altenschöpfer, Dusseldorf; Klaus Schumann, Erkrath, both of Fed. Rep. of Germany

[73] Assignee: Henkel Kommanditgesellschaft Auf Aktien, Dusseldorf-Holthausen, Fed. Rep. of Germany

[21] Appl. No.: 226,145

[22] Filed: Jan. 19, 1981

[30] Foreign Application Priority Data

Jan. 26, 1980 [DE] Fed. Rep. of Germany ..... 3002789

[51] Int. Cl.[3] ..... C11D 1/72; C11D 7/50

[52] U.S. Cl. ..... 252/174.19; 252/142; 252/143; 252/146; 252/173; 252/174.21; 252/DIG. 14; 252/DIG. 2; 252/171

[58] Field of Search ..... 252/146, 143, 148, DIG. 10, 252/173, 174.19, 174.21, DIG. 14, 142, 171, 136; 134/40, 46

[56] References Cited

U.S. PATENT DOCUMENTS

| | | | |
|---|---|---|---|
| 1,494,147 | 5/1924 | Braun | 252/143 |
| 3,294,695 | 12/1966 | Tippett | 252/146 X |
| 3,650,964 | 3/1972 | Sedliar | 252/106 |
| 3,909,437 | 9/1975 | Alexander et al. | 252/143 |
| 3,969,134 | 7/1976 | Batka et al. | 134/26 |
| 4,172,044 | 10/1979 | Zeidler et al. | 252/143 X |
| 4,239,552 | 12/1980 | Perner et al. | 134/28 |
| 4,247,408 | 1/1981 | Inamura et al. | 252/143 |

*Primary Examiner*—P. E. Willis, Jr.
*Attorney, Agent, or Firm*—Hammond & Littell, Weissenberger and Muserlian

[57] ABSTRACT

A liquid, aqueous or aqueous-alcoholic cleaning and maintenance composition, especially for dishwashers, consisting essentially of:

(a) from 5% to 50% by weight of a water-soluble, organic monocarboxylic or polycarboxylic acid having from 2 to 6 carbon atoms, optionally substituted with hydroxyl groups,
(b) from 3% to 20% by weight of a water-soluble polyhydric alcohol,
(c) from 0.1% to 10% by weight of a low-sudsing nonionic tenside,
(d) from 0 to 5% by weight of customary additives selected from the group consisting of odorants, dyes, dissolving intermediaries and corrosion inhibitors,
(e) from 0 to 30% by weight of a water-miscible monohydric alcohol having from 2 to 4 carbon atoms, and
(f) the remainder to 100% by weight of water, based on the total weight of the composition.

6 Claims, No Drawings

LIQUID CLEANING AND MAINTENANCE COMPOSITION ESPECIALLY FOR DISHWASHERS

BACKGROUND OF THE INVENTION

In the area of door sealings, hose connections and low water zones of mechanical dishwashers, that is, where the surfaces of the interior of the dishwasher are not exposed to the direct and intensive operating pressure spray of the cleaning liquor, soil is frequently deposited in the course of time. This soil consists mainly of finely-divided fatty food residues.

Occasional unavoidable troubles in the ion-exchange system of the dishwasher water supply, which serve to soften the water used, or the consistent underdosing of the dishwasher detergents by the user also cause increasingly deposits of a mixture of calcium from hard water and residues of the detergent on the inner surfaces of the machines.

Partly so-called "tempering colors" are formed, as rainbow-colored discolorations of refined steel parts of the dishwasher or of dishes of refined steel are called.

These deposits represent an undesired nutrient soil for rotting processes, which manifest themselves by an unpleasant odor, particularly when the dishwasher is opened after it has not been used for a long time. Beyond that, hose and sealing materials, particularly at the door, are damaged by prolonged action of these soil deposits.

The commercial powdered alkaline or acid dishwasher detergents or clean rinse agents are not or only inadequately suitable for cleaning the so-called "problem zones" of dishwashers where soil is particularly likely to be deposited. These dishwasher detergents are dose into the washing and rinsing cycle of the dishwashers and are dissolved therein; however, the soiled regions are not touched at all or only briefly by them. It is, therefore, necessary to clean these zones manually. The detergents used for cleaning the dishes are unsuitable for this purpose, since they irritate the skin. Commercial cleansers for hard surfaces are not suitable either for these special applications, since they contain generally high-sudsing tensides or surface-active compounds whose residues can lead to various troubles in dishwashers.

OBJECTS OF THE INVENTION

An object of the present invention is the development of liquid cleaning and maintenance compositions especially for mechanical dishwashers.

Another object of the present invention is the development of a liquid, aqueous or aqueous-alcoholic cleaning and maintenance composition, especially for dishwashers, consisting essentially of:

(a) from 5% to 50% by weight of an acid having from 2 to 6 carbon atoms selected from the group consisting of alkanoic acids, hydroxy substituted alkanoic acids, alkane polycarboxylic acids and hydroxy substituted alkane polycarboxylic acids, (b) from 3% to 20% by weight of a water-soluble alkane polyol, (c) from 0.1% to 10% by weight of a low-sudsing nonionic tenside, (d) from 0 to 5% by weight of customary additives selected from the group consisting of odorants, dyes, dissolving intermediaries and corrosion inhibitors, (e) from 0 to 30% by weight of a water-miscible alkanol having from 2 to 4 carbon atoms, and (f) the remainder to 100% by weight of water, where the amount of water is at least 25% by weight, based on the total weight of the composition.

These and other objects of the invention will become more apparent as the description thereof proceeds.

DESCRIPTION OF THE INVENTION

The present invention concerns a liquid, aqueous or aqueous-alcoholic cleaning and maintenance composition which is characterized in that it contains:

from 5% to 50%, preferably from 12% to 25%, by weight of a water-soluble organic monocarboxylic acid or polycarboxylic acid with 2 to 6 carbon atoms in the molecule, substituted, optionally, by hydroxy groups, from 3% to 20%, preferably 5% to 12%, by weight of a water-soluble polyhydric alcohol, from 0.1% to 10%, preferably 1% to 5%, by weight of a low-sudsing nonionic tenside, and from 0 to 5%, preferably 0.1% to 4.5%, by weight of odorants, dyes, dissolving intermediaries and/or inhibitors, related to the total weight of the aqueous or aqueous-alcoholic solution.

More particularly, the present invention relates to a liquid, aqueous or aqueous-alcoholic cleaning and maintenance composition, especially for dishwashers, consisting essentially of:

(a) from 5% to 50% by weight of an acid having from 2 to 6 carbon atoms selected from the group consisting of alkanoic acids, hydroxy substituted alkanoic acids, alkane polycarboxylic acids and hydroxy substituted alkane polycarboxylic acids, (b) from 3% to 20% by weight of a water-soluble alkane polyol, (c) from 0.1% to 10% by weight of a low-sudsing nonionic tenside, (d) from 0 to 5% by weight of customary additives selected from the group consisting of odorants, dyes, dissolving intermediaries and corrosion inhibitors, (e) from 0 to 30% by weight of a water-miscible alkanol having from 2 to 4 carbon atoms, and (f) the remainder to 100% by weight of water, where the amount of water is at least 25% by weight, based on the total weight of the composition.

In addition to at least 25% by weight of water, the composition of the invention can contain from 0 to 30%, preferably from 15% to 20%, by weight of a monohydric alcohol with 2 to 4 carbon atoms, particularly a water-miscible alkanol having from 2 to 4 carbon atoms, such as ethanol, propanol, butanol and preferably isopropanol.

The water-soluble organic monocarboxylic or polycarboxylic acids with 2 to 6 carbon atoms in the molecule, substituted if necessary by hydroxy groups, consist primarily of alkanoic acids, hydroxyalkanoic acids, alkane polycarboxylic acids and hydroxyalkane polycarboxylic acids. In addition to acetic acid, preferably polycarboxylic acids which have a K value of $>10^{-6}$, related to the first dissociation stage are employed. These are, for example, adipic acid, succinic acid, tartaric acid, malic acid, glutaric acid, and preferably citric acid. Mixtures of these acids can also be used.

The water-soluble polyhydric alcohols are preferably water-soluble alkane polyols having from 2 to 6 carbon atoms and from 2 to 3 hydroxyls in the molecule, such as ethylene glycol, propylene glycol, dipropylene glycol and preferably glycerin.

In order to increase the detergent power, known low-sudsing nonionic tensides are used which are used, too, as components of detergents for the mechanical cleaning of dishes, suitable are oxide adducts onto higher molecular weight propylene glycols with molecular weights of 900 to 4,000, as well as adducts of 1 to 10 mols of ethylene oxide or 1 to 10 mols of ethylene oxide and 1 to 7 mols of propylene oxide onto higher molecular weight fatty alcohols with 10 to 20, preferably 12 to 18, carbon atoms in the molecule, or mixtures thereof, as well as synthetic alcohols of the chain length $C_{12}$–$C_{18}$ produced by oxosynthesis, and corresponding alkylene oxide adducts on nonylphenols. Preferred are the biodegradable adducts of ethylene oxide and propylene oxide onto higher molecular weight fatty alcohols, particularly the addition product of 2 to 5 mols of ethylene oxide and 2 to 5 mols of propylene oxide onto a mixture of $C_{12}$–$C_{18}$ fatty alcohols.

Apart from dyes and odorants, small amounts of about 0.1% to 4.5% by weight of customary dissolving intermediaries for the tensides and/or odorants can be added, e.g., $C_1$–$C_3$-alkylbenzene sulfonates, especially cumene-sulfonates, as well as corrosion inhibitors, e.g., a condensation product of aldehydes and amines in an acid medium known under the name of Rodin 58 ® by Gerhard Collardin GmbH, Cologne, Germany.

The products according to the invention can be added to the unloaded dishwashers in concentrations of 5 to 40, preferably 10 to 25, gm/liter in certain intervals, for example, once or twice a month, especially in the washing or optionally in the rinsing cycle and left there at least for about five minutes at an elevated temperature of about 25° to 60° C., but they can also be used manually preferably in concentrated form.

The liquid, acid cleaning and maintenance agents according to the invention dissolve and remove both the fatty food residues and calcium and detergent residues in dishwashers. Tempering colors too disappear on rubbing. Due to their content of polyvalent alcohols, premature drying of the agent is prevented. This way not only rubber and plastic seals or connections are kept soft and elastic, but stubborn stains are softened and can be easily wiped off, due to the delayed drying.

The following examples illustrate the invention in more detail without being limitative thereof.

EXAMPLE 1

| Percent By Weight | |
|---|---|
| 1.5 | An adduct of 2 mols of ethylene oxide and 4 mols of propylene oxide onto a technical mixture of $C_{12}$–$C_{18}$ fatty alcohols, |
| 15.0 | Citric acid |
| 8.0 | Glycerine, anhydrous |
| 20.0 | Isopropanol |
| 4.0 | Dipropylene glycol |
| 0.15 | An odorant |
| 50.25 | Water. |

EXAMPLE 2

The following composition was mixed together:

| Percent By Weight | |
|---|---|
| 3.0 | A 1:1 mixture of an adduct of 2 mols of ethylene oxide and 4 mols of propylene oxide onto a technical mixture of $C_{12}$–$C_{18}$ fatty alcohols and an adduct of 5 mols of ethylene oxide and 4 mols of propylene oxide onto a technical mixture of $C_{12}$–$C_{18}$ fatty alcohols, |
| 15.0 | Citric acid |
| 3.0 | Acetic acid |
| 10.0 | Ethylene glycol |
| 22.0 | Isopropanol |
| 6.5 | Corrosion inhibitor, "Rodine 58" ® |
| 40.5 | Water. |

EXAMPLE 3

The following composition was mixed together:

| Percent By Weight | |
|---|---|
| 3.5 | An adduct of 4 mols of ethylene oxide and 2 mols of propylene oxide onto a technical $C_{12}$-$C_{18}$ fatty alcohol mixture, |
| 6.0 | Tartaric acid |
| 3.0 | Adipic acid |
| 2.0 | Succinic acid |
| 5.0 | Glutaric acid |
| 2.0 | Citric acid |
| 10.0 | Glycerine anhydrous |
| 18.0 | Ethanol |
| 0.2 | Odorant |
| 50.3 | Water. |

EXAMPLE 4

Cleaning Effect

The following test arrangement was used to determine the cleaning effect of the manually applied agent of the invention on rubber or plastic parts of dishwashers:

A plastic test plate of 26×28 cm was employed. Two grams of an artificial soil consisting of a mixture of soot, machine oil, triglycerides of saturated fatty acids and low boiling aliphatic hydrocarbons were applied evenly to the plates by means of an applicator.

A plastic sponge was saturated with 12 ml of the detergent solution according to Examples 1 to 3 to be tested, and moved mechanically over the test area. After six wiping movements, the cleaned test area was held under running water and the loose soil was removed. The cleaning effect, that is, the whiteness of the plastic surface thus cleaned, was measured with a photoelectric colorimeter LF 90 (Dr. B. Lange). The original clean white plastic surface was used as a white standard. In the measurement, this clean surface was adjusted to be 100% and the artificially soiled surface was adjusted to be 0%. The indicated values of the cleaned plastic surface must be considered as percent cleaning effect (% CE). These are mean values from four determinations. With tap water, a mean value of 21% CE was obtained.

| Example | % CE |
|---|---|
| 1 | 71 |
| 2 | 77 |
| 3 | 75 |

EXAMPLE 5

The result of the mechanical application of the detergent according to the invention for cleaning the interior of dishwashers was determined in the form of the calcium dissolving power and of the cleaning power. To this end one of the agents according to Examples 1 to 3, at a rate of 250 ml, was put into the cleaning cycle of a commercial dishwasher Model Miele G 540, with a water content of 10.0±0.5 l and a maximum washing temperature of 55° C.±3° C.

Calcium Dissolving Power

Glass plates 6×12 were covered evenly with a layer of 5 gm of a mixture of:

| Grams | |
|---|---|
| 80 | Calcium carbonate |
| 7 | Sodium metasilicate, anhydrous |
| 4 | Magnesium carbonate-hexahydrate |
| 2 | Gelatin |
| 60 | Water |

and dried for one and half hours at 80° C. This resulted in a stable "calcium deposit". Four glass plates each were washed with one of the agents according to Examples 1 to 3 in the dishwasher. The mean percentual removal of the calcium deposit (calcium dissolving power) was determined by titrimetric determination of the residual amounts of $Ca^{++}$- and $Mg^{++}$-ions. The calcium dissolving power effected solely with water of 55° C. by mechanical removal in the dishwasher was 30%.

| Example | % Calcium Dissolving Power |
|---|---|
| 1 | 75 |
| 2 | 81 |
| 3 | 69 |

Cleaning Power

Thirty grams of soil consisting of:

| Grams | |
|---|---|
| 100 | Margarine |
| 50 | Raw egg (white and yellow) |
| 50 | Defrosted frozen spinach |
| 100 | Drinking milk, 1.5% fat content |
| 100 | Food grade rolled oats |
| 280 | Mashed potatoes |
| 400 | Brown gravy |

where applied in stripes on refined steel surfaces of the interior of three dishwashers, Model Miele G 540, by means of a brush and left drying for twenty hours at room temperature. Then one agent each according to Examples 1 to 3 was put into the cleaning cycle of the dishwashers and the latter started as usual. Subsequently the result was judged by three test persons. The original, new refined steel inner surface was graded as 10 (absolutely clean) and the refined steel surfaces obtained after soiling as 0. With pure water treatment at 55° C., a cleaning power grade of 5.5 was obtained.

| Example | Cleaning Power |
|---|---|
| 1 | 8.5 |
| 2 | 9.5 |
| 3 | 8.0 |

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A liquid, aqueous or aqueous-alcoholic cleaning and maintenance composition, especially for dishwashers, consisting essentially of:
   (a) from 12% to 25% by weight of an acid having from 2 to 6 carbon atoms and having a first dissociation stage K value of $>10^{-6}$ selected from the group consisting of alkanoic acids, hydroxy substituted alkanoic acids, alkane polycarboxylic acids and hydroxy substituted alkane polycarboxylic acids,
   (b) from 5% to 12% by weight of glycerol,
   (c) from 1% to 5% by weight of a low-sudsing nonionic tenside,
   (d) from 0 to 5% by weight of customary additives selected from the group consisting of odorants, dyes, dissolving intermediaries and corrosion inhibitors,
   (e) from 0 to 30% by weight of a water-miscible alkanol having from 2 to 4 carbon atoms, and
   (f) the remainder to 100% by weight of water, where the amount of water is at least 25% by weight, based on the total weight of the composition.

2. The liquid composition of claim 1 wherein component (a) is an acid selected from the group consisting of acetic acid, citric acid and mixtures thereof.

3. The liquid composition of claim 1 wherein component (c) is a nonionic tenside selected from the group consisting of adducts of 1 to 10 mols of ethylene oxide onto $C_{10}$–$C_{20}$ fatty alcohols and adducts of 1 to 10 mols of ethylene oxide and 1 of 7 mols of propylene oxide onto $C_{10}$–$C_{20}$ fatty alcohols.

4. The liquid composition of claim 3 wherein the fatty alcohols have from 12 to 18 carbon atoms.

5. The liquid composition of claim 1 wherein component (c) is an adduct of 2 to 5 mols of ethylene oxide and 2 to 5 mols of propylene oxide onto $C_{12}$–$C_{18}$ fatty alcohols.

6. The liquid composition of claim 1 wherein component (c) is a low-sudsing nonionic tenside selected from the group consisting of ethylene oxide adducts onto high molecular weight propylene glycols having molecular weights of 900 to 4,000, adducts of 1 to 10 mols of ethylene oxide onto $C_{10}$–$C_{20}$ fatty alcohols, adducts of 1 to 10 mols of ethylene oxide and 1 to 7 mols of propylene oxide onto $C_{10}$–$C_{20}$ fatty alcohols, adducts of 1 to 10 mols of ethylene oxide onto $C_{12}$-$C_{18}$ synthetic alcohols produced by oxosynthesis, adducts of 1 to 10 mols of ethylene oxide and 1 to 7 mols of propylene oxide onto $C_{12}$–$C_{18}$ synthetic alcohols produced by oxosynthesis, adducts of 1 to 10 mols of ethylene oxide onto nonylphenol and adducts of 1 to 10 mols of ethylene oxide and 1 to 7 mols of propylene oxide onto nonylphenol.

* * * * *